US007840150B2

(12) United States Patent
Mori et al.

(10) Patent No.: US 7,840,150 B2
(45) Date of Patent: Nov. 23, 2010

(54) IMAGE FORMING APPARATUS HAVING A PLURALITY OF HEATING DEVICES FOR HEATING RECORDING SHEET

(75) Inventors: Akihito Mori, Toride (JP); Keizo Isemura, Koganei (JP)

(73) Assignee: Canon Kabushiki Kaisha (JP)

( * ) Notice: Subject to any disclaimer, the term of this patent is extended or adjusted under 35 U.S.C. 154(b) by 894 days.

(21) Appl. No.: 11/468,441

(22) Filed: Aug. 30, 2006

(65) Prior Publication Data

US 2007/0053731 A1 Mar. 8, 2007

(30) Foreign Application Priority Data

Sep. 5, 2005 (JP) ..... 2005-257065

(51) Int. Cl.
*G03G 15/20* (2006.01)

(52) U.S. Cl. ..... 399/69; 399/68; 399/341

(58) Field of Classification Search ..... 399/341, 399/67–69; 430/124.13, 124.2
See application file for complete search history.

(56) References Cited

U.S. PATENT DOCUMENTS 5,890,032 A * 3/1999 Aslam et al. ..... 399/69
2002/0085856 A1* 7/2002 Kuwabara ..... 399/92

FOREIGN PATENT DOCUMENTS

| | | | |
|---|---|---|---|
| JP | 64-35452 A | | 2/1989 |
| JP | 4-362679 A | | 12/1992 |
| JP | 11352840 A | * | 12/1999 |
| JP | 2003-84477 A | | 3/2003 |

* cited by examiner

*Primary Examiner*—David M Gray
*Assistant Examiner*—Gregory H Curran
(74) *Attorney, Agent, or Firm*—Rossi, Kimms & McDowell LLP

(57) ABSTRACT

An image forming apparatus has: a first heating device which heats recording sheet formed with a developer image; a cooling device which cools the recording sheet passing through the first heating device; a second heating device which heats the recording sheet cooled by the cooling device and gives a gloss to the image on the recording sheet; a conveying device which conveys the recording sheet passing through the first heating device to the second heating device through the cooling device; and a controller which controls a cooling ability of the cooling device in accordance with a conveying time required until the recording sheet is conveyed from the first heating device to the second heating device.

8 Claims, 11 Drawing Sheets

IMAGE FORMING APPARATUS HAVING A PLURALITY OF HEATING DEVICES FOR HEATING RECORDING SHEET

BACKGROUND OF THE INVENTION

1. Field of the Invention

The invention relates to an image forming apparatus having a plurality of fixing means.

2. Description of the Related Art

Hitherto, image forming apparatuses of an electrophotographic type have widely been known as image forming apparatuses such as copying apparatus, printer, and the like. Among the electrophotographic type image forming apparatuses, there is an apparatus which can form not only a monochromatic image but also a full-color image. Since the electrophotographic type image forming apparatuses are used in various fields, a demand to realize high picture quality is rising. Smoothness of a surface of an output image formed on recording sheet (paper) can be mentioned as one of factors which decide the picture quality, particularly, a glossy degree of the full-color image. It is strongly required to improve the smoothness. To satisfy such a request, there has been proposed an image forming method of forming a color image by transferring a color toner image made of a thermoplastic resin onto recording sheet having a transparent resin layer made of the thermoplastic resin and fixing the color toner image (for example, refer to Japanese Patent Application Laid-Open Nos. S64-35452 and H05-216322).

A fixing unit using a belt has been proposed as a construction of a fixing unit suitable for the above image forming method (for example, refer to Japanese Patent Application Laid-Open No. H04-362679). In such a belt fixing unit, recording sheet on which an unfixed toner image has been held is thermally pressed by a fixing belt made of a heat resisting film, and the recording sheet is cooled in the state where it has been closely adhered onto the fixing belt. Thus, the toner image is solidified and fixed onto the recording sheet. The recording sheet on which the toner image has been fixed is peeled off from the fixing belt and delivered to the outside.

In this instance, since the toner image is coagulated along a belt surface shape together with a transparent resin layer by the belt fixing unit in the state where the toner image has been embedded in the transparent resin layer of the recording sheet and the whole surface of the recording sheet becomes a smooth surface, a color image having excellent glossiness can be obtained.

As recording sheet having the transparent resin layer, recording sheet formed with a resin layer which is made of a thermoplastic resin whose glass transition temperature is equal to or lower than 358° K. as a main component and whose thickness is equal to about 10 μm has been proposed (for example, refer to Japanese Patent Application Laid-Open No. 2003-084477).

As an image forming apparatus which can form an image onto the recording sheet having the transparent resin layer, there is an apparatus having a first fixing unit and a second fixing unit constructed by a belt fixing unit. In such an image forming apparatus, a first fixing mode and a second fixing mode are switched in accordance with a type of recording sheet. The first fixing mode is a fixing mode for normal recording sheet. In the case of the first fixing mode, the recording sheet to which a toner image has been transferred is conveyed so that it passes through the first fixing unit and does not pass through the second fixing unit. The second fixing mode is a fixing mode for the recording sheet having the transparent resin layer. In the case of the second fixing mode, first, the toner image on the recording sheet having the transparent resin layer is fixed onto the recording sheet by the first fixing unit. Subsequently, the recording sheet is sent to the second fixing unit. In the second fixing unit, the fixing process is executed so as to obtain the state where the toner image has been embedded in the transparent resin layer on the recording sheet.

Ordinarily, the recording sheet after passing through the fixing unit is in the state where a heat has been accumulated in the sheet. Therefore, if the recording sheet passes through a curved conveying path in the heat accumulation state, a curl of the recording sheet occurs. Before the toner image which has been heated and pressed by the fixing unit solidifies, the toner image is rubbed by conveying rollers, guide ribs, and the like, so that such a phenomenon that its rubbing trace appears as a variation in gloss, or the like occurs. Therefore, to suppress the occurrence of such a curl of the recording sheet, rubbing trace of the toner image, or the like, a cooling unit to promptly cool the recording sheet just after the passage through the first fixing unit is provided. In the first fixing mode, just after the recording sheet passed through the first fixing unit, it is promptly cooled.

In the second fixing mode, in a manner similar to the first fixing mode, in the case of promptly cooling the recording sheet which passed through the first fixing unit (recording sheet having the transparent resin layer), the recording sheet which has once been cooled is heated again by the second fixing unit. In order to allow the recording sheet which has once been cooled to be heated again to a predetermined temperature, it is necessary to use a method whereby a heat capacity of the second fixing unit is increased, a target temperature of temperature adjustment is raised, a fixing nip pressure is raised, or the like.

However, in the second fixing unit, in order to increase the heat capacity of the second fixing unit or raise the target temperature of temperature adjustment, an amount of electric power which is supplied to the second fixing unit increases. In other words, electric power consumption in the second fixing unit increases. In the case of raising the fixing nip pressure, it is necessary to increase a torque of a driving motor of a fixing roller or a pressing roller, so that a driving mechanism in the second fixing unit enlarges in size and a deterioration in separating performance of the recording sheet from the second fixing unit, or the like is caused.

SUMMARY OF THE INVENTION

It is an object of the invention to provide an image forming apparatus which can solve the foregoing problems.

Another object of the invention is to provide an image forming apparatus which can stably output an image of high picture quality having no gloss variation without causing an increase in wasteful electric power consumption in a second fixing unit and an increase in size of a driving mechanism.

Other objects of the present invention will become apparent from the following detailed description and the appended claims with reference to the accompanying drawings.

According to the first aspect of the invention, there is provided an image forming apparatus comprising: a first heating device which heats recording sheet on which a developer image has been formed; a cooling device which cools the recording sheet which has passed through the first heating device; a second heating device which heats the recording sheet cooled by the cooling device and gives a gloss to the image on the recording sheet; a conveying device which conveys the recording sheet which has passed through the first heating device to the second heating device through the cooling device; and a controller which controls a cooling ability of the cooling device in accordance with a conveying time that is required until the recording sheet is conveyed from the first heating device to the second heating device.

Further features of the present invention will become apparent from the following description of exemplary embodiments with reference to the attached drawings.

DESCRIPTION OF THE EMBODIMENTS

Embodiments of the invention will be described hereinbelow with reference to the drawings.

First Embodiment

Figure 1:
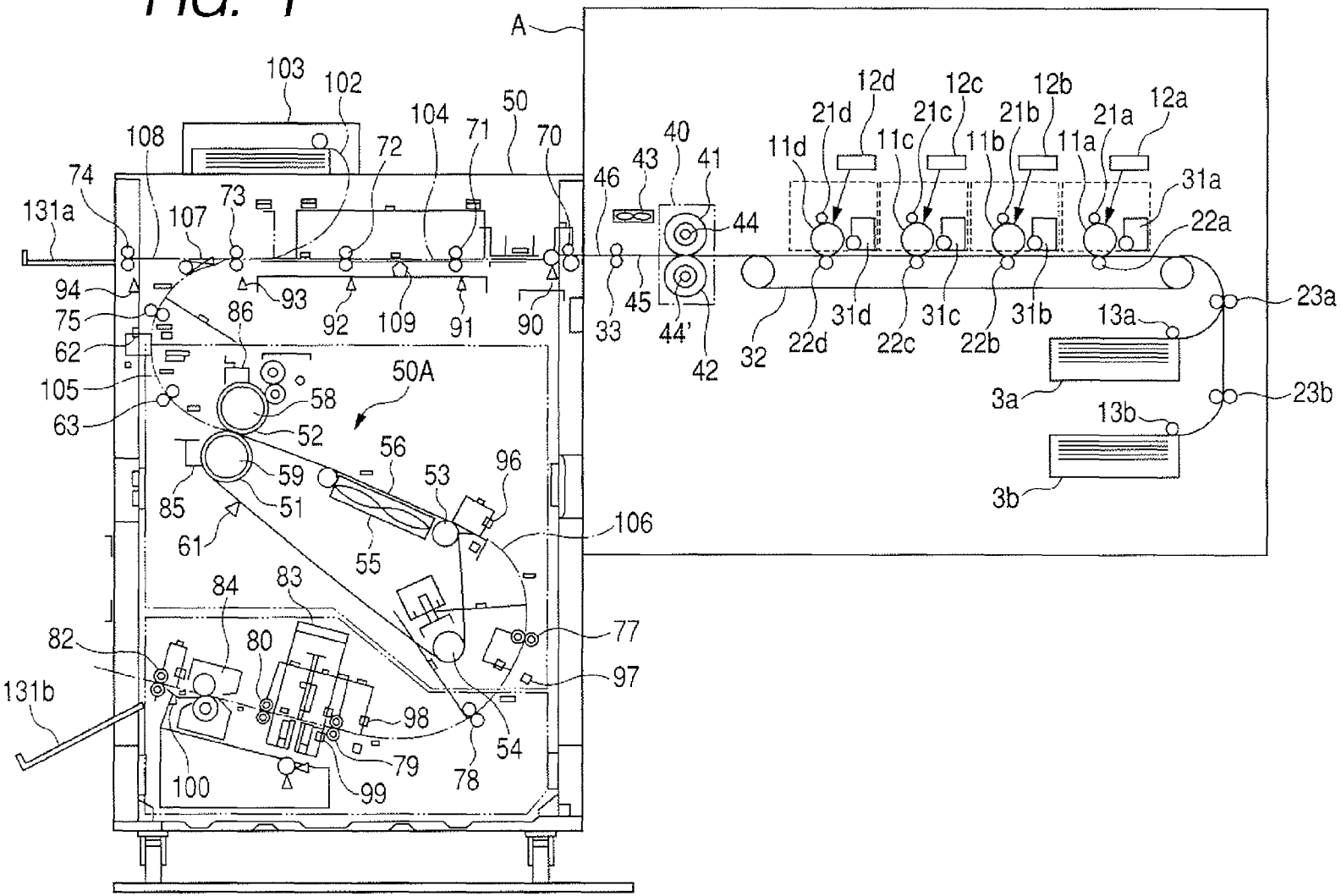
FIG. 1 is a vertical sectional view showing a construction of an image forming apparatus according to the first embodiment of the invention.

As shown in FIG. 1, an image forming apparatus A is a tandem type image forming apparatus which can form a color image onto recording sheet. In the image forming apparatus A, image forming stations of colors of yellow, magenta, cyan, and black are provided. The yellow image forming station has a photosensitive drum 11*a*, a primary charging unit 21*a*, a laser unit 12*a*, a developing unit 31*a*, and a transfer unit 22*a*. The primary charging unit 21*a* uniformly charges the surface of the photosensitive drum 11*a* to a predetermined electric potential. The laser unit 12*a* irradiates a laser beam onto the photosensitive drum 11*a* while scanning it. Thus, a latent image is formed onto the photosensitive drum 11*a*. The developing unit 31*a* supplies toner of the corresponding color to the photosensitive drum 11*a* and visualizes the latent image formed on the photosensitive drum 11*a* as a toner image. The transfer unit 22*a* transfers the toner image on the photosensitive drum 11*a* onto the recording sheet which has been fed out of a feed cassette 3*a* or 3*b* and conveyed by a transfer belt 32.

In a manner similar to the yellow image forming station, the magenta image forming station has a photosensitive drum 11*b*, a primary charging unit 21*b*, a laser unit 12*b*, a developing unit 31*b*, and a transfer unit 22*b*. Similarly, the cyan image forming station has a photosensitive drum 11*c*, a primary charging unit 21*c*, a laser unit 12*c*, a developing unit 31*c*, and a transfer unit 22*c*. The black image forming station has a photosensitive drum 11*d*, a primary charging unit 21*d*, a laser unit 12*d*, a developing unit 31*d*, and a transfer unit 22*d*.

The recording sheet which is fed out of the feed cassette 3*a* or 3*b* passes through a feed roller 13*a* or 13*b* and a conveying roller 23*a* or 23*b* and is conveyed to the transfer belt 32. The transfer belt 32 conveys the recording sheet while holding it so that the recording sheet sequentially passes through the image forming stations. When the recording sheet passes through each of the image forming stations, the toner image formed in each of the image forming stations is overlaid and transferred onto the recording sheet. Thus, the full-color toner image is formed on the recording sheet.

The recording sheet held by the transfer belt 32 is separated from the transfer belt 32 and guided to a first fixing unit (first heating device) 40. The first fixing unit 40 has a fixing roller 41 having a heater 44 therein and a pressing roller 42 having a heater 44' therein. The fixing roller 41 and the pressing roller 42 are mutually pressed by a predetermined pressure. A nip portion to sandwich and convey the recording sheet is formed between the fixing roller 41 and the pressing roller 42. A surface temperature of each of the fixing roller 41 and the pressing roller 42 is held to a predetermined temperature by controlling the driving of each of the heaters 44 and 44'. In the first fixing unit 40, when the recording sheet passes through the nip portion, a heat and a pressure are applied to the sheet, so that the toner image on the recording sheet is fixed thereon.

The construction of the image forming apparatus A is not limited to that mentioned above. For example, it is also possible to use a well-known construction using an intermediate transfer material belt in place of the transfer belt.

The recording sheet which passed through the first fixing unit 40 is guided toward a discharge roller 33 along a conveying path 45. The discharge roller 33 sends the recording sheet to a second fixing unit 50 along a conveying path 46. A cooling fan 43 to cool the recording sheet which passed through the first fixing unit 40 is arranged at a position near an outlet of the first fixing unit 40.

The second fixing unit 50 has a belt fixing unit (second heating device) 50A. In the second fixing unit 50, the recording sheet sent from the image forming apparatus A is conveyed toward a flapper 107 along a conveying path 104 by conveying rollers 70, 71, 72, and 73. A temperature sensor 109 is arranged at a position between the conveying rollers 71 and 72. A plurality of sensors 90, 91, 92, and 93 to detect the recording sheet are provided for the conveying path 104.

The flapper 107 operates so as to switch a conveying destination of the recording sheet in accordance with a fixing mode, which will be explained hereinafter. When the selected fixing mode is a first fixing mode, the flapper 107 executes the switching operation so as to guide the recording sheet to a conveying path 108. The recording sheet guided to the conveying path 108 by the flapper 107 is delivered to a discharge tray 131*a* through a discharge roller 74. A sensor 94 to detect the recording sheet is provided near the discharge roller 74.

When the selected fixing mode is a second fixing mode, the flapper 107 executes the switching operation so as to guide the recording sheet to a conveying path 105. The recording sheet guided to the conveying path 105 is conveyed toward a resist roller 63 by a conveying roller 75. After the resist roller 63 temporarily stopped the recording sheet, it sends the sheet to the belt fixing unit 50A at predetermined timing. The belt fixing unit 50A will be described in detail hereinafter. A resist sensor 62 to detect a front edge of the recording sheet is arranged at a position between the conveying roller 75 and the resist roller 63 on the conveying path 105.

The recording sheet which passed through the belt fixing unit 50A is sent to a cutter portion 83 along a conveying path 106 by conveying rollers 77, 78, and 79. The cutter portion 83 cuts right and left edges (edge portions along the conveying direction) of the recording sheet by a predetermined cutting width. The recording sheet whose right and left edges have been cut by the cutter portion 83 is sent to a cutter portion 84 by a conveying roller 80. The cutter portion 84 cuts upper and lower edges (edge portions along the direction which perpendicularly crosses the conveying direction) of the recording sheet by a predetermined cutting width. The predetermined cutting width of each of the cutter portions 83 and 84 is narrower than a blank region width of each of the right and left edges or each of the upper and lower edges of the recording sheet. The positioning operation of the recording sheet to the cutter portions 83 and 84 is executed by the conveying rollers 79 and 80. The recording sheet whose upper and lower edges have been cut by the cutter portion 84 is delivered onto a discharge tray 131*b* by a discharge roller 82.

A plurality of sensors 96, 97, and 98 to detect the recording sheet are provided for the conveying path 106. A sensor 99 to detect the recording sheet is arranged on the downstream side of the conveying roller 79. A sensor 100 to detect the recording sheet is arranged at a position between the cutter portion 84 and the discharge roller 82.

An inserter 103 is provided for the second fixing unit 50. The inserter 103 feeds insertion sheet to be inserted between the two sheets of recording sheet along a conveying path 102.

The belt fixing unit 50A has an endless fixing belt 56 for conveying the recording sheet while holding it. The fixing belt 56 is stretched across a fixing roller 51, a driven roller 53, and a tension roller 54. The fixing belt 56 is driven by the fixing roller 51. A home position of the fixing belt 56 is detected by a sensor 61. A pressing roller 52 which faces the fixing roller 51 through the fixing belt 56 is pressed to the fixing roller 51 by a predetermined pressure.

The fixing belt 56 is made of an endless base material. A mirror-surface-like layer having surface releasing performance (surface releasing layer) is formed on the surface (surface which is come into contact with the recording sheet or the pressing roller 52) of the fixing belt 56. For example, the base material is formed by a belt of a stainless sheet having a thickness of 100 μm. The surface releasing layer is made of PFA (tetrafluoroethylene perfluoroalkyl vinyl ether copolymer) having a thickness of 10 μm as a kind of fluororesin.

The fixing roller 51 has a core portion made by a cylindrical member. An elastic layer is formed on the surface of the core portion. The surface releasing layer is formed on the elastic layer. For example, the core portion is formed by a hollow pipe made of aluminum whose diameter is equal to 44 mm and whose thickness is equal to 5 mm. The elastic layer is made of silicon rubber whose JIS-A hardness is equal to 50° and whose thickness is equal to 3 mm. The surface releasing layer is made of a PFA having a thickness of 50 μm. A halogen lamp 58 as a heat source is built in the core portion. The pressing roller 52 has a construction similar to that of the fixing roller 51. A halogen lamp 59 is built in the pressing roller 52.

Surface temperatures of the fixing roller 51 and the pressing roller 52 are detected by thermistors 85 and 86. The driving of the halogen lamps 58 and 59 are controlled on the basis of the temperatures detected by the thermistors 85 and 86. The surface temperature of each of the fixing roller 51 and the pressing roller 52 is controlled so as to become a predetermined fixing temperature.

A cooling fan 55 to cool the recording sheet held onto the fixing belt 56 is provided between the fixing roller 51 and the driven roller 53. The cooling fan 55 is arranged on the back side of the fixing belt 56 and generates an airflow directing from the back side of the fixing belt 56 to the front side.

A predetermined tension is applied to the fixing belt 56 by the tension roller 54 so that a curvature of the fixing belt 56 in a region which is cooled by the cooling fan 55 is held to an almost predetermined curvature by rigidity of the fixing belt 56.

In the embodiment, normal recording sheet (hereinafter, referred to as first type of recording sheet) and recording sheet on which a transparent resin layer made of a thermoplastic resin as a main component has been formed (hereinafter, referred to as second type of recording sheet) can be used as recording sheet which is used for the image creation. In the case of forming the image to the first type of recording sheet, the first fixing mode is selected. In the case of forming the image to the second type of recording sheet, the second fixing mode is selected.

The first fixing mode is a mode in which the toner image on the first type of recording sheet is fixed onto the recording sheet by using the first fixing unit 40 without using the second fixing unit 50. The second fixing mode is a mode in which the toner image on the second type of recording sheet is fixed onto the recording sheet by using the first fixing unit 40 and the second fixing unit 50.

Since the belt fixing unit 50A of the second fixing unit gives the gloss to the image fixed by the first fixing unit, the second fixing mode can be also called a gloss applying mode. Similarly, the second fixing unit 50 can be also called a gloss applying device).

The second type of recording sheet has: a base material having a pigment coating layer made of an adhesive agent and a pigment as main components on at least one surface; and a resin layer made of a thermoplastic resin formed on the pigment coating layer as a main component. The resin layer contains the thermoplastic resin and a thermosetting resin as main components. In place of such a resin layer, a mixture resin layer in which the thermoplastic resin and the thermosetting resin are mixed can be also used. The resin layer can be also constructed by a plurality of layers including a thermoplastic resin layer made of a thermoplastic resin as a main component and a thermosetting resin layer made of a thermosetting resin as a main component. However, in the case of constructing the resin layer by a plurality of layers, the top layer among them is the thermosetting resin layer made of the thermosetting resin as a main component. A layer structure in which the mixture resin layer, thermoplastic resin layer, and thermosetting resin layer are combined can be also used. In this case, it is necessary to set the top layer among them to a layer containing a thermosetting resin such as mixture resin layer, thermosetting resin layer, or the like. As a thermoplastic resin, a polyester resin, styrene-acrylic ester, styrene-methacrylic ester, or the like can be used. Particularly, it is preferable to use the polyester resin.

Figure 2:
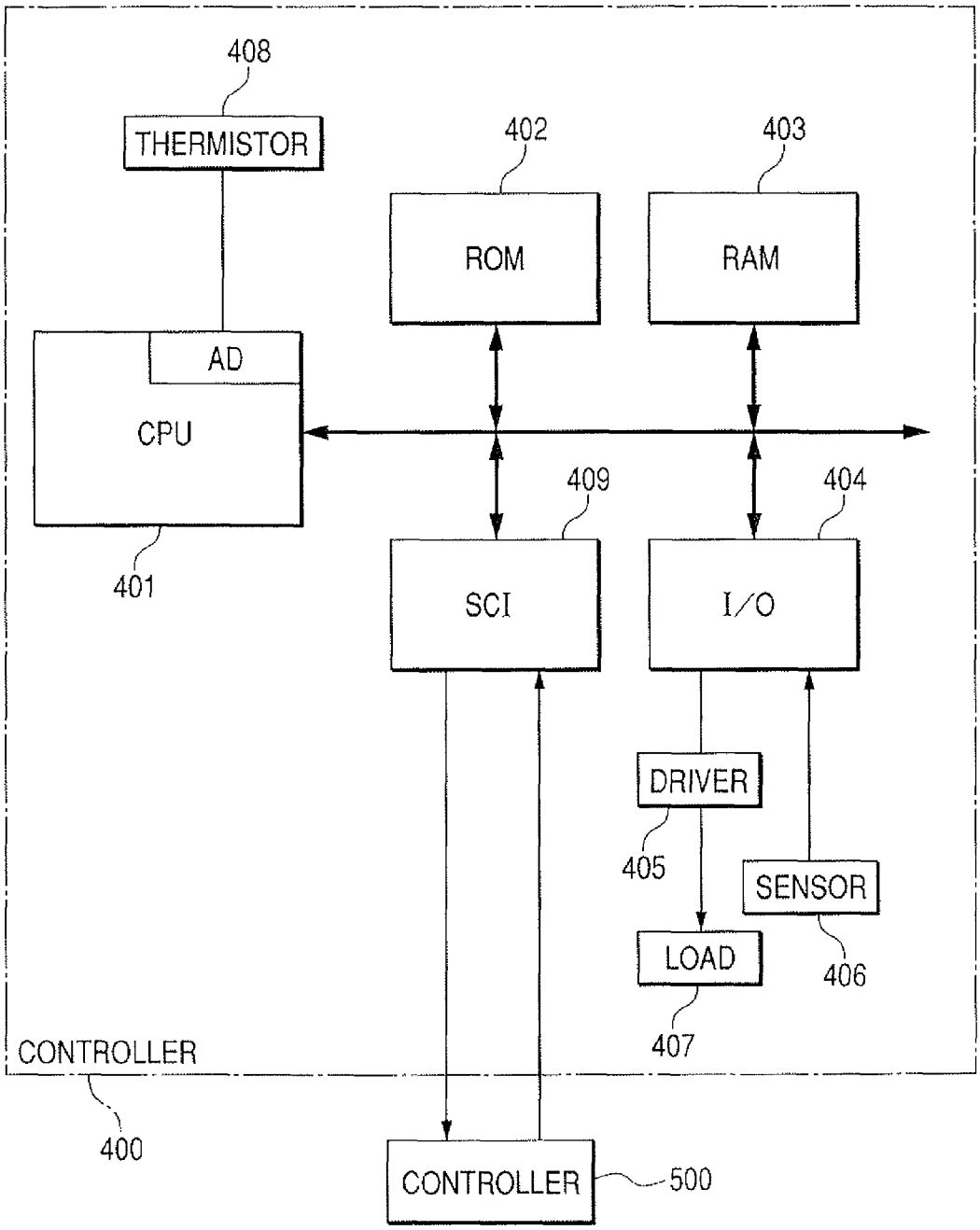
FIG. 2 is a block diagram showing a control construction for controlling the whole apparatus including an image forming apparatus A and a second fixing unit 50 in FIG. 1.

A control construction of the whole apparatus including the image forming apparatus A and the second fixing unit 50 will now be described with reference to FIG. 2. FIG. 2 is a block diagram showing the control construction for controlling the whole apparatus including the image forming apparatus A and the second fixing unit 50 in FIG. 1.

As shown in FIG. 2, the control of the whole apparatus including the image forming apparatus A and the second fixing unit 50 is made by a controller 400. The controller 400 has: a CPU 401; a ROM 402; a RAM 403; an I/O (input/output port) 404; and a SCI (Serial Communication Interface) 409. A control program which is executed by the CPU 401 and various kinds of data have been stored in the ROM 402. The RAM 403 provides a work area for the CPU 401. The I/O port 404 receives outputs from a group of sensors 406 and sends them to the CPU 401. The group of sensors 406 includes: the sensor to detect the recording sheet in the image forming apparatus A; the temperature sensor to detect the temperature in the apparatus; and the like. The I/O port 404 outputs a control signal which is inputted from the CPU 401 and used to control the driving of a group of loads 407 to a driver 405. The group of various kinds of loads 407 includes: various driving motors for the cooling fan 43, fixing roller 41, transfer belt 32, and the like; a clutch; a solenoid; and the like. The driver 405 drives the corresponding load on the basis of the control signal. The SCI 409 is connected to a controller 500 of the second fixing unit 50. The controller 400 transmits and receives information to/from the controller 500 through the SCI 409.

The CPU 401 of the controller 400 controls various kinds of operations regarding the image creation in accordance with the set mode. For example, the CPU 401 controls the driving of the heaters 44 and 44' on the basis of an output (inputted through an A/D port) of a thermistor 408 to detect the surface temperature of the fixing roller 41. Thus, the surface temperature of each of the fixing roller 41 and the pressing roller 42 is controlled to a predetermined fixing temperature. The CPU 401 also controls the driving of the cooling fan 43 so as to vary the output thereof in accordance with the selected fixing mode. The drive control of the cooling fan 43 will be described in detail hereinbelow.

The controller 500 of the second fixing unit 50 makes various kinds of control on the basis of commands which are inputted from the controller 400 of the image forming apparatus A while monitoring the detection outputs of the sensors in the second fixing unit 50. For example, the controller 500 makes the following various kinds of control: temperature control in the belt fixing unit 50A; switching control of a conveying destination of the recording sheet by the flapper 107; conveying control of the recording sheet by the conveying rollers; operation control of the cutter portions 83 and 84; and the like. The controller 500 has a construction similar to that of the controller 400 and detailed explanation of its construction is omitted here.

The first fixing mode will now be described in detail.

The first fixing mode is executed in the case of forming the image onto the first type of recording sheet. After the toner image was transferred onto the first type of recording sheet, the sheet is sent to the first fixing unit 40. The first type of recording sheet to which the toner image has been transferred is heated and pressed by the first fixing unit 40, so that the toner image is fixed onto the first type of recording sheet. The first type of recording sheet which passed through the first fixing unit 40 is promptly cooled by the cooling fan 43 and, thereafter, sent from the image forming apparatus A to the second fixing unit 50.

The first type of recording sheet which was sent to the second fixing unit 50 is conveyed along the conveying path 104 by the conveying rollers 70, 71, 72, and 73 and guided to the conveying path 108 by the flapper 107. The first type of recording sheet guided to the conveying path 108 is delivered onto the discharge tray 131*a* through a discharge roller 74.

When the first type of recording sheet which passed through the first fixing unit 40 is conveyed without being cooled by the cooling fan 43, the heat accumulated in the first type of recording sheet is slowly radiated, so that the first type of recording sheet is gradually curled. Consequently, the first type of recording sheet is delivered in the curled state onto the discharge tray 131*a*. If the sheets of first type of curled recording sheet are continuously delivered onto the discharge tray 131*a* in this manner, stacking performance of the first type of recording sheet on the discharge tray 131*a* deteriorates and quality of the output sheet also deteriorates.

When the first type of recording sheet which passed through the first fixing unit 40 is not cooled by the cooling fan 43, before the fixed toner image on the first type of recording sheet is dried, if the toner image is come into contact with the conveying rollers, guide ribs, and the like and is rubbed, the rubbed portion causes a gloss variation. Thus, the picture quality of the image formed on the first type of recording sheet is deteriorated.

Therefore, it is necessary that the first type of recording sheet which passed through the first fixing unit 40 is cooled by the cooling fan 43. The driving of the cooling fan 43 is controlled by the controller 400. Also in the case where the second fixing unit 50 is not connected to the image forming apparatus A, the first type of recording sheet which passed through the first fixing unit 40 is similarly cooled by the cooling fan 43.

Figure 3A:
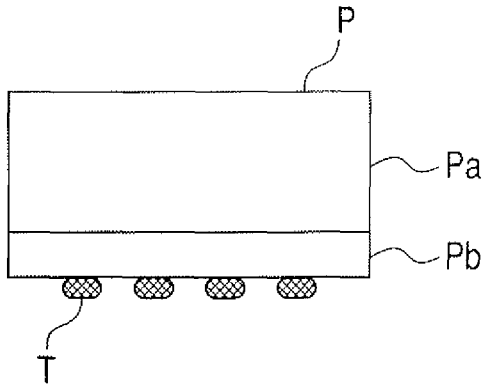
FIG. 3A is a diagram schematically showing a fixing state of a toner image on a second type of recording sheet after it passed through a first fixing unit 40.
Figure 3B:
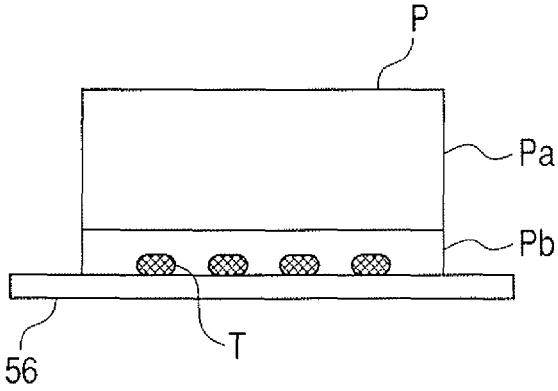
FIG. 3B is a diagram schematically showing a fixing state of the toner image on the second type of recording sheet after it passed through a belt fixing unit 50A.
Figure 4:
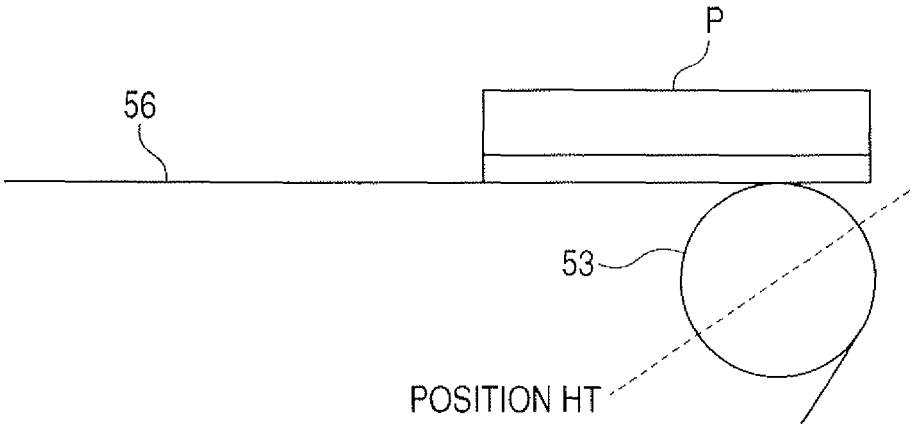
FIG. 4 is a diagram schematically showing a state in the case where the second type of recording sheet is peeled off from a fixing belt 56 of the second fixing unit 50.
Figure 5:
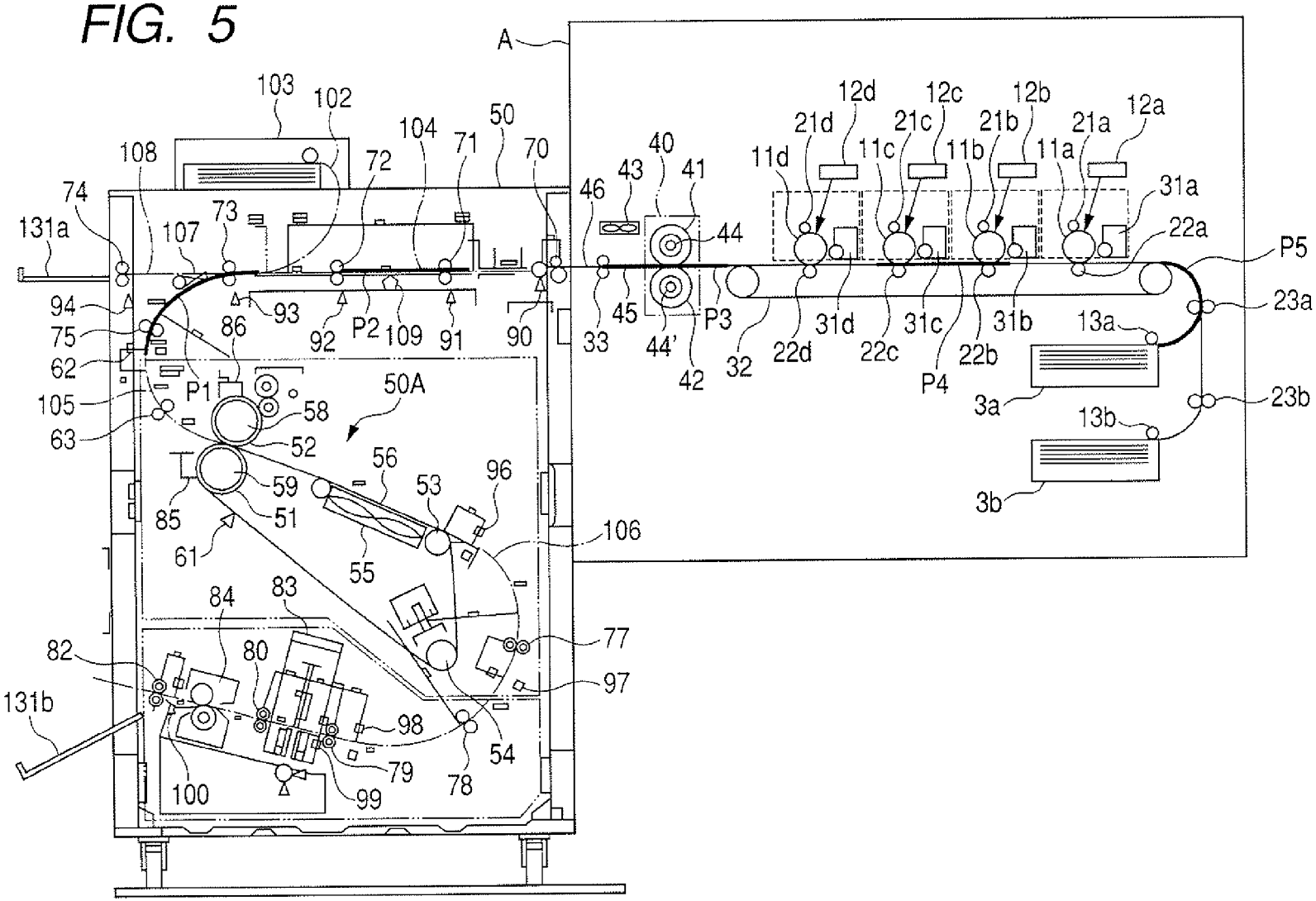
FIG. 5 is a diagram schematically showing a flow of the second type of recording sheet in the case of continuously forming images by using the second type of recording sheet.
Figure 6:
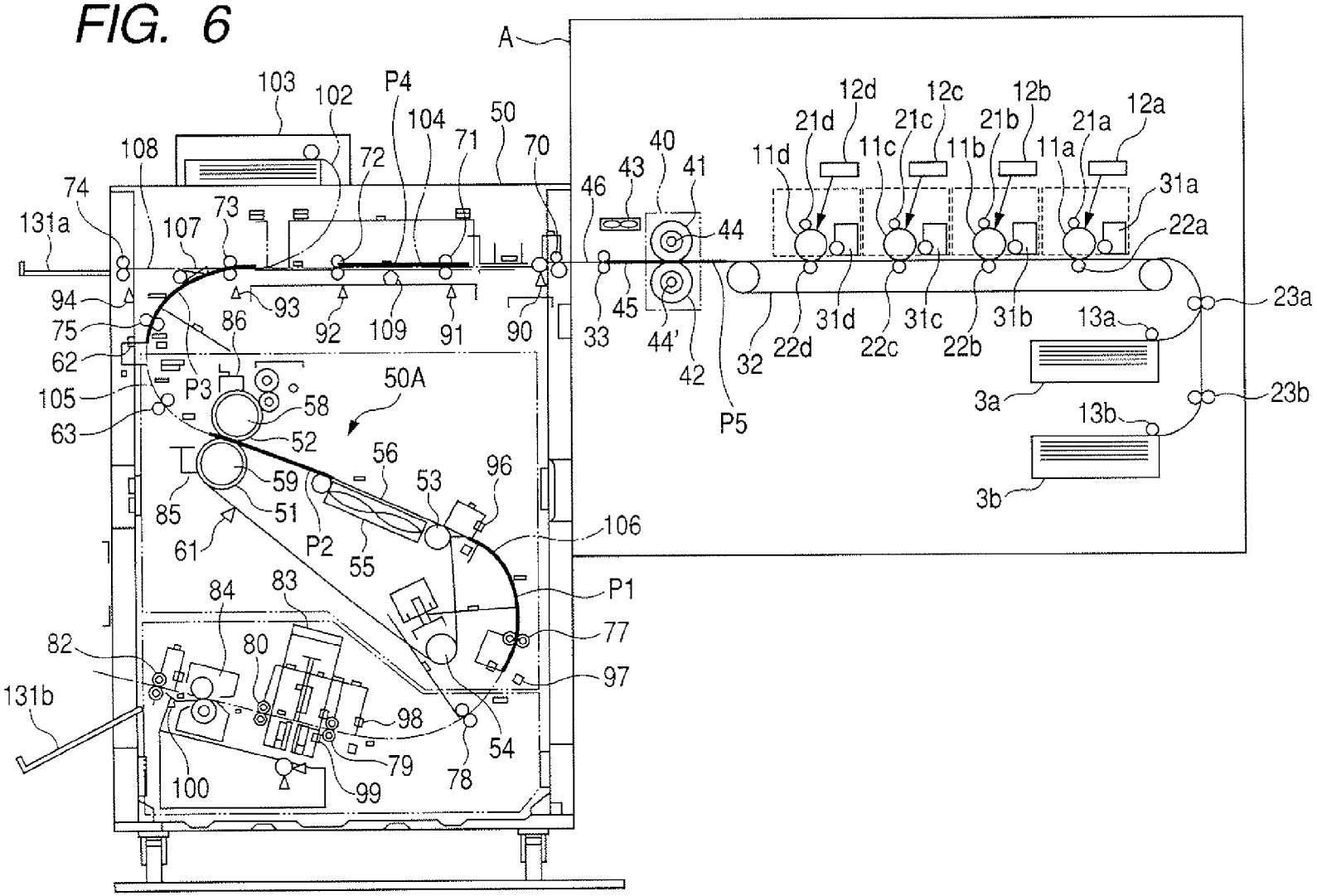
FIG. 6 is a diagram schematically showing a flow of the second type of recording sheet in the case of continuously forming the images by using the second type of recording sheet.
Figure 7:
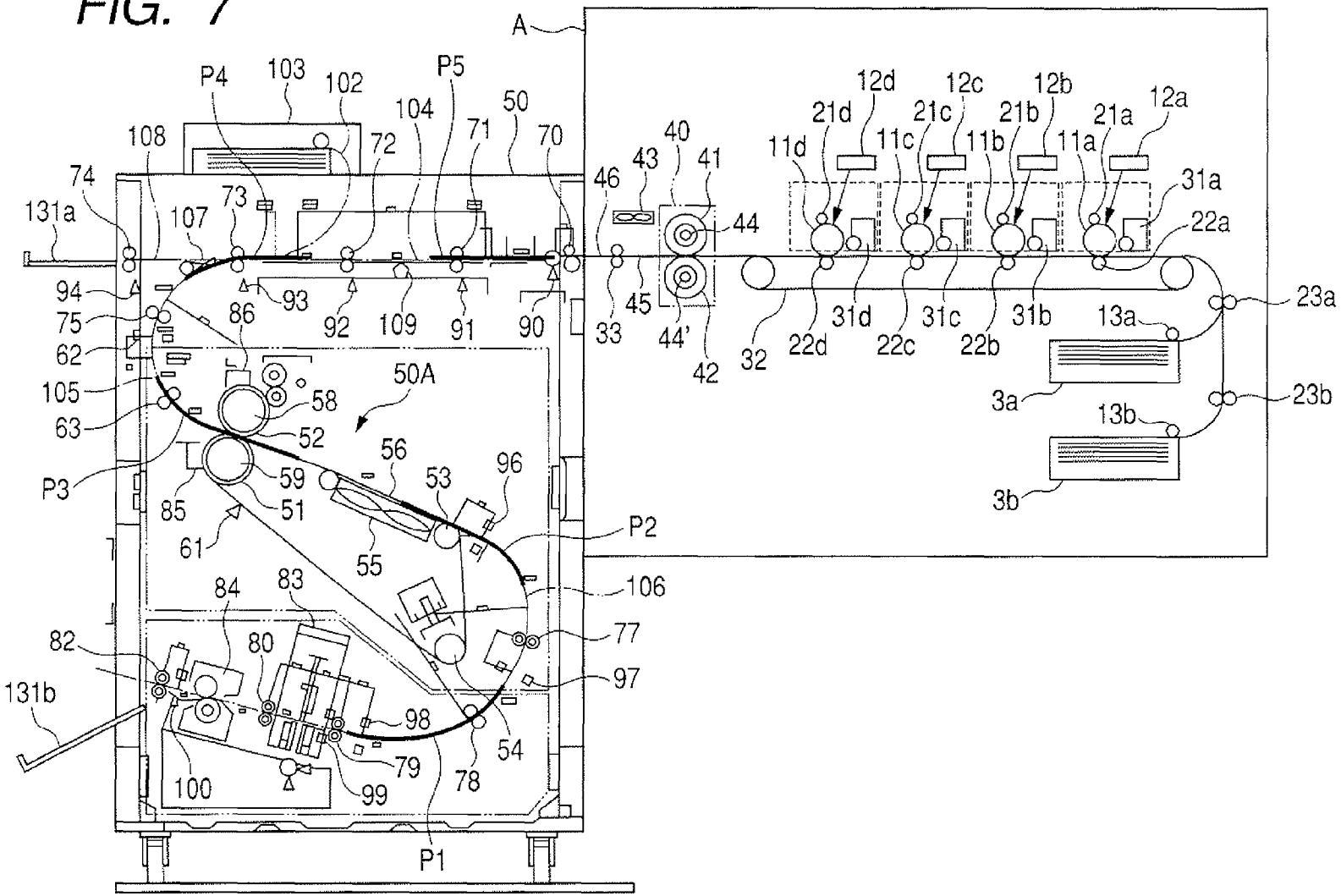
FIG. 7 is a diagram schematically showing a flow of the second type of recording sheet in the case of continuously forming the images by using the second type of recording sheet.

The second fixing mode will now be described in detail with reference to FIGS. 3A to 7. FIG. 3A is a diagram schematically showing a fixing state of the toner image on the second type of recording sheet after it passed through the first fixing unit 40. FIG. 3B is a diagram schematically showing a fixing state of the toner image on the second type of recording sheet after it passed through the belt fixing unit 50A. FIG. 4 is a diagram schematically showing a state in the case where the second type of recording sheet is peeled off from the fixing belt 56 of the second fixing unit 50. FIGS. 5 to 7 are diagrams schematically showing a flow of the sheets of second-type recording sheet in the case of continuously forming images by using the second type of recording sheet. The case of continuously forming the images to five sheets of second type of recording sheet in a photographing mode will now be described. The photographing mode is a mode to form an output matter having picture quality similar to that of a silver 0 salt photograph.

In the case of continuously forming the images to five sheets of second type of recording sheet P1 to P5, first, a toner image of each color is formed onto the first sheet of second-type recording sheet P1 and the first sheet of second-type recording sheet P1 is fed at predetermined timing. The toner images of the respective colors are overlaid and transferred to the second type of recording sheet P1, so that the full-color toner image is transferred to the second type of recording sheet P1. The second type of recording sheet P1 is sent to the first fixing unit 40. In the first fixing unit 40, the first sheet of second-type recording sheet P1 is heated and pressed and the toner image is fixed onto to the second type of recording sheet P1. The second type of recording sheet P1 which passed through the first fixing unit 40 is cooled by the cooling fan 43 and, thereafter, sent to the second fixing unit 50 from the image forming apparatus A. The cooling fan 43 is driven under control corresponding to the second fixing mode. The drive control of the cooling fan 43 in the second fixing mode will be described in detail hereinafter.

The second type of recording sheet P1 sent to the second fixing unit 50 is conveyed along the conveying path 104 by the conveying rollers 70, 71, 72, and 73 and guided to the conveying path 105 by the flapper 107. When the second type of recording sheet P1 guided to the conveying path 105 is conveyed by the conveying roller 75 and detected by the sensor 62, it is temporarily stopped in the state where a front edge of the second type of recording sheet P1 has been abutted to the resist roller 63. At this time, as shown in FIG. 5, the second sheet of second-type recording sheet P2 is detected by the sensor 92 and stopped in the state where it is sandwiched by the conveying roller 72. The third sheet of second-type recording sheet P3 is passing through the first fixing unit 40 of the image forming apparatus A. Further, the fourth sheet of second-type recording sheet P4 is held and conveyed by the transfer belt 32 and the image forming operation is executed to the second type of recording sheet P4. Moreover, the fifth sheet of second-type recording sheet P5 is in the state where it has been fed from the feed cassette 3*a* and is being conveyed toward the transfer belt 32.

When the second type of recording sheet P1 is temporarily stopped in the state it was abutted to the resist roller 63, the fixing belt 56 has already been driven. Timing when a recording sheet holding position HT on the fixing belt 56 reaches the nip portion between the fixing belt 56 and the pressing roller 52 is calculated by the CPU 401 on the basis of a detection output of the sensor 61 to detect a home position of the fixing belt 56. The resist roller 63 is rotated so that the calculated timing and timing when the front edge of the second type of recording sheet P1 reaches the nip portion are synchronized (coincide), so that the second type of recording sheet P1 is fed to the nip portion. The recording sheet holding position HT on the fixing belt 56 is a reference position to hold the second type of recording sheet on the fixing belt 56. The second type of recording sheet is held on the fixing belt 56 so that the front edge reaches the recording sheet holding position HT.

Subsequently, the second type of recording sheet P1 passes through the nip portion. In this instance, the second type of recording sheet P1 and the toner images on the second type of recording sheet P1 are heated at a predetermined fixing temperature and pressed at a predetermined pressure by the fixing roller 51 and the pressing roller 52. Thus, the transparent resin layer formed on the second type of recording sheet P1 is softened and the state where the toner image is embedded into the transparent resin layer is obtained.

In more detail, as shown in FIG. 3A, before the recording sheet passes through the nip portion between the fixing belt 56 and the pressing roller 52, its toner image T has been fixed in such a state where it is located on a transparent resin layer Pb formed on a base material Pa of a second type of recording sheet P. When the second type of recording sheet P passes through the nip portion, as shown in FIG. 3B, the transparent resin layer Pb of the second type of recording sheet P is softened and the toner image T is embedded into the transparent resin layer Pb. At the same time, the second type of recording sheet P is conveyed while it is being held on the fixing belt 56.

Subsequently, when the second type of recording sheet P1 conveyed by the fixing belt 56 reaches a cooling area where it is cooled by the cooling fan 55, in this cooling area, the second type of recording sheet P1 is cooled by the airflow which is generated by the cooling fan 55. The airflow which is generated by the cooling fan 55 is guided to the cooling area by a duct (not shown) so as to efficiently cool the second type of recording sheet. Since the toner image T is embedded in the transparent resin layer Pb and further cooled, a gloss similar to that of the silver salt photograph is given to the image on the second type of recording sheet P1.

When the second type of recording sheet P1 cooled in this manner reaches an area where a curvature of the fixing belt 56 changes by the driven roller 53, it is peeled off from the surface of the fixing belt 56 by its own rigidity. In more detail, as shown in FIG. 4, after the recording sheet holding position HT of the fixing belt 56 reached the area where the curvature of the fixing belt 56 is changed by the driven roller 53, the front edge of the second type of recording sheet P starts to be peeled off from the surface of the fixing belt 56.

Subsequently, as shown in FIG. 6, the second type of recording sheet P1 peeled off from the fixing belt 56 is conveyed along the conveying path 106 and passes through the sensor 97. When the second type of recording sheet P1 passes through the sensor 97, the second sheet of second-type recording sheet P2 is sent to the nip portion between the fixing belt 56 and the pressing roller 52. In the nip portion, the second type of recording sheet P2 is heated and pressed and the toner image is embedded into the transparent resin layer of the second type of recording sheet P2. The third sheet of second-type recording sheet P3 is detected by the sensor 62 and temporarily stopped in the state where its front edge has been abutted to the resist roller 63. The fourth sheet of second-type recording sheet P4 is detected by the sensor 92 and stopped in the state where it has been sandwiched by the conveying roller 72. The fifth sheet of second-type recording sheet P5 is passing through the first fixing unit 40 of the image forming apparatus A.

As shown in FIG. 7, the first sheet of second-type recording sheet P1 is conveyed to a cutter registration pre-sensor 98, sandwiched by the conveying roller 79, and temporarily stopped. At this time, the second sheet of second-type recording sheet P2 is peeled off from the fixing belt 56 and conveyed along the conveying path 106. The third sheet of second-type recording sheet P3 is passing through the nip portion between the fixing belt 56 and the pressing roller 52. In the second type of recording sheet P3, the toner image is embedded into the transparent resin layer in a manner similar to the precedent second type of recording sheets P1 and P2. The fourth sheet of second-type recording sheet P4 has been conveyed along the conveying path 107. The fifth sheet of second-type recording sheet P5 has been conveyed along the conveying path 104. In a manner similar to the above, the second type of recording sheets P4 and P5 pass through the nip portion and the toner images on the second type of recording sheets P4 and P5 are embedded into the transparent resin layer.

Subsequently, the first sheet of second-type recording sheet P1 is sent to the cutter portions 83 and 84. The right and left edges and the upper and lower edges of the second type of recording sheet P1 are cut by the cutter portions 83 and 84. The second type of recording sheet P1 after the cutting is delivered onto the discharge tray 131*b*.

The subsequent second type of recording sheets P2 to P5 are sent to the cutter portions 83 and 84 in a manner similar to the first sheet of second-type recording sheet P1, and the right and left edges and the upper and lower edges of each of the second type of recording sheets P2 to P5 are cut by the cutter portions 83 and 84. The second type of recording sheets P2 to P5 after the cutting are delivered onto the discharge tray 131*b*.

Figure 8:
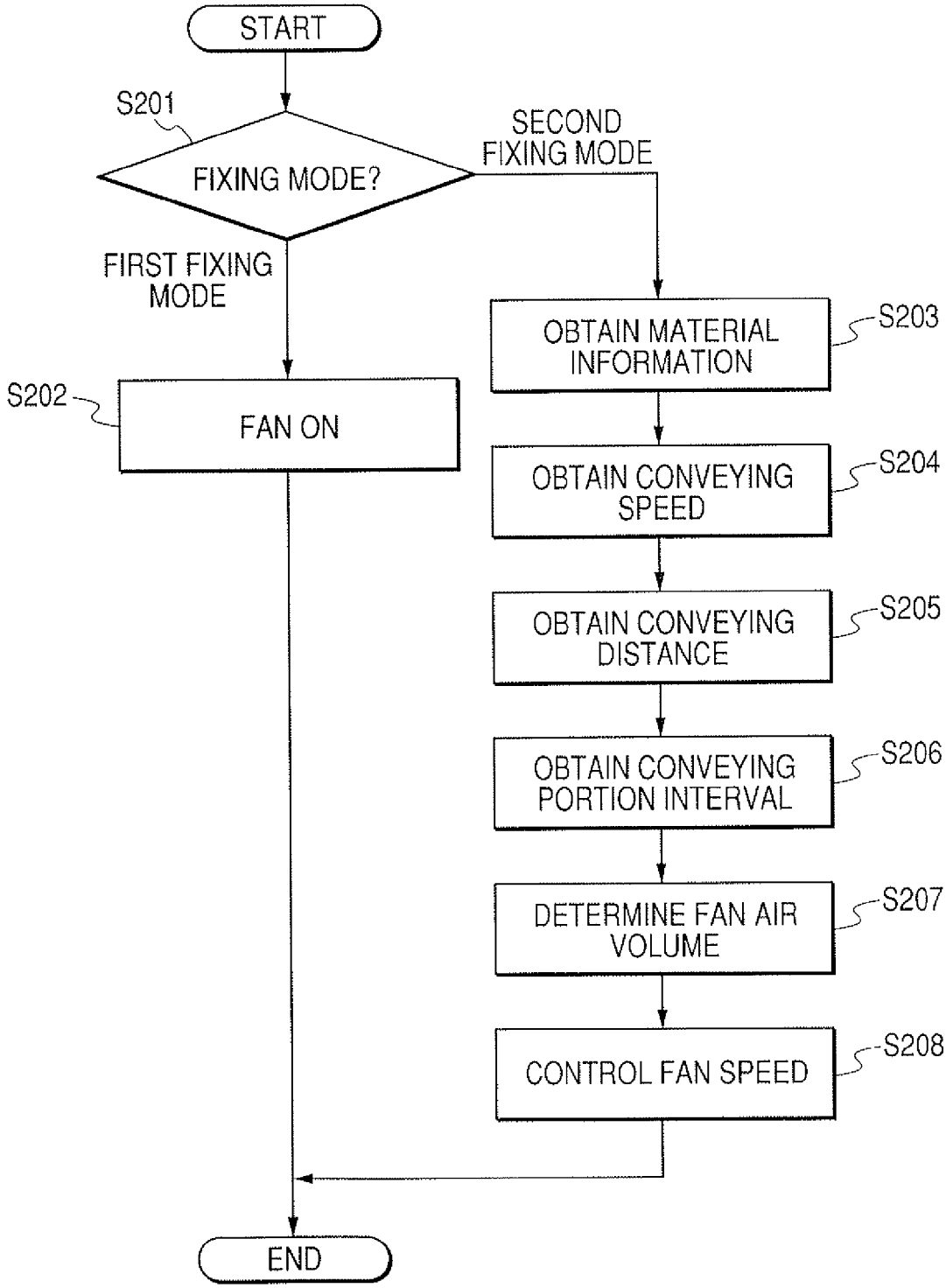
FIG. 8 is a flowchart showing a procedure for drive control of a cooling fan 43.

The drive control of the cooling fan 43 will now be described with reference to FIG. 8. FIG. 8 is a flowchart showing a procedure for the drive control of the cooling fan 43. The procedure shown in the flowchart of FIG. 8 is executed by the controller 400 (CPU 401) of the image forming apparatus A.

The drive control of the cooling fan 43 is made by the controller 400 of the image forming apparatus A. This control is started in response to the start of a print job. The controller 400 receives a detection value of the temperature sensor 109 from the controller 500. As shown in FIG. 8, first, the controller 400 discriminates whether the selected fixing mode is the first fixing mode or the second fixing mode (step S201). The first fixing mode is a fixing mode in the case of performing the image creation to the first type of recording sheet (normal recording sheet). The second fixing mode is a fixing mode in the case of performing the image creation to the second type of recording sheet. The selection between the fixing modes is automatically made in accordance with an image forming mode set by the user. For example, when the image forming mode using the first type of recording sheet is set, the first fixing mode is selected, and when the image forming mode using the second type of recording sheet is set, the second fixing mode is selected.

If it is determined in step S201 that the selected fixing mode is the first fixing mode, the controller 400 controls so as to drive the cooling fan 43 at a fan full rotational speed (fan on) (step S202). The controller 400 finishes the present processing routine. When the job is finished after that, the controller 400 stops the driving of the cooling fan 43.

If it is determined in step S201 that the selected fixing mode is the second fixing mode, the controller 400 obtains material information (information regarding a sheet size, a material, and the like) of the second type of recording sheet which is fed (step S203). Subsequently, the controller 400 obtains information indicative of a conveying speed of the second type of recording sheet corresponding to the material information obtained in step S203 from the controller 500 of the second fixing unit 50 (step S204). The obtained conveying speed information indicates the conveying speed of the second type of recording sheet in the second fixing unit 50. The conveying speed differs depending on the sheet size, material, and the like and those speeds have previously been stored in a ROM in the controller 500 of the second fixing unit 50 in correspondence to the obtained material information.

Subsequently, the controller 400 obtains information indicative of a conveying distance from the first fixing unit 40 to the belt fixing unit 50A in the second fixing unit 50 (step S205). The information showing the conveying distance from an entrance of the second fixing unit 50 to the belt fixing unit 50A is obtained from the controller 500 of the second fixing unit 50. The conveying distance information has been stored in the ROM in the controller 500.

The second type of recording sheet is temporarily stopped at a predetermined position of the conveying path from of the first fixing unit 40 to the belt fixing unit 50A in the second fixing unit 50 in order to match the timing for conveying the sheet to the second fixing unit. The reason why the second type of recording sheet is temporarily stopped is that when the second type of recording sheet which was precedently conveyed is cut by the cutter portions 83 and 84, it is intended to prevent the next second type of recording sheet from colliding with the second type of recording sheet which is being cut by the cutter portions 83 and 84. The controller 400 obtains interval (temporary stop time) information of a conveying portion showing an interval of the temporary stop from the controller 500 of the second fixing unit 50 (step S206). For example, as a conveying portion interval, there is an interval when the second type of recording sheet is temporarily stopped by the resist roller 63, or the like. The conveying portion interval differs depending on the sheet size, the presence or absence of the insertion of the inserter sheet, and the like. The conveying portion interval information is obtained in consideration of them.

Subsequently, the controller 400 calculates an arrival time until the second type of recording sheet reaches the belt fixing unit 50A in the second fixing unit 50 from the first fixing unit 40. The arrival time is obtained by adding the conveying portion interval to the conveying time (=conveying distance/conveying speed) which is obtained on the basis of the conveying distance and the conveying speed. The controller 400 decides an air volume of the cooling fan 43 on the basis of the calculated arrival time and temperature drop distribution data which has previously been held in the ROM 402 (step S207). Specifically speaking, the air volume of the cooling fan 43 is determined so that a temperature (sheet temperature) of the second type of recording sheet when the second type of recording sheet has reached the belt fixing unit 50A is set to a temperature within a predetermined range. Further, the longer the calculated arrival time is, the more a cooling ability of the cooling fan 43 deteriorates. In this instance, the air volume of the cooling fan 43 is determined to either a first air volume (=zero air volume) at the time when the cooling fan 43 has been stopped or a second air volume which is obtained when the cooling fan 43 has been driven at a half rotational speed (fan half). However, the air volume of the cooling fan may be changed to one of three or more levels.

Subsequently, the controller 400 controls so as to drive the cooling fan 43 at a fan rotational speed according to the air volume of the cooling fan 43 decided in step S207 (step S208). For example, when the decided air volume of the cooling fan 43 is the first air volume, the cooling fan 43 is stopped. On the other hand, when the decided air volume of the cooling fan 43 is the second air volume, the cooling fan 43 is driven at the half rotational speed (fan half). The driving at the half rotational speed (fan half) of the cooling fan 43 is made by controlling a drive current to the cooling fan 43. The controller 400 finishes the present processing routine.

After that, when the job is finished, the controller 400 stops the driving of the cooling fan 43.

Figure 9:
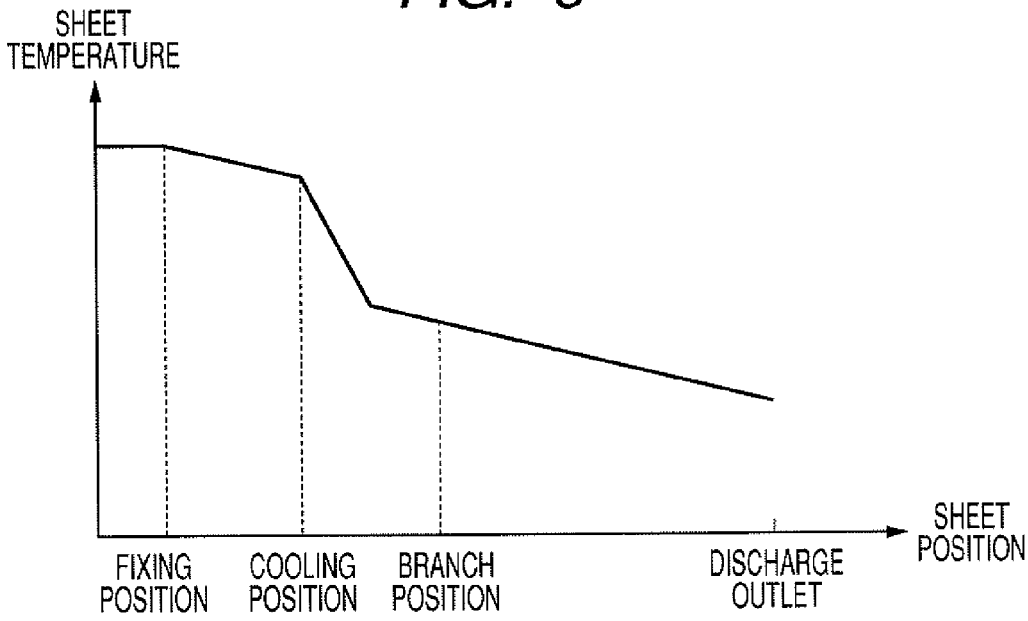
FIG. 9 is a diagram showing a temperature change of a first type of recording sheet when the cooling fan 43 is driven at a full rotational speed in a first fixing mode.
Figure 10:
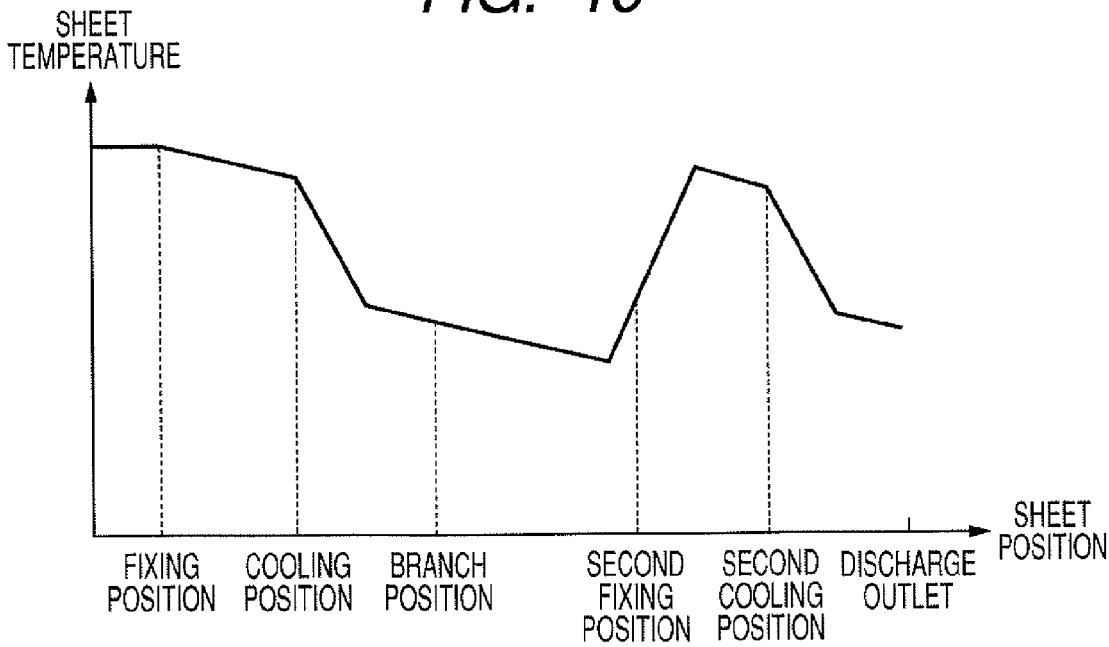
FIG. 10 is a diagram showing a temperature change of the second type of recording sheet in the case of driving the cooling fan 43 at the full rotational speed in a second fixing mode.
Figure 11:
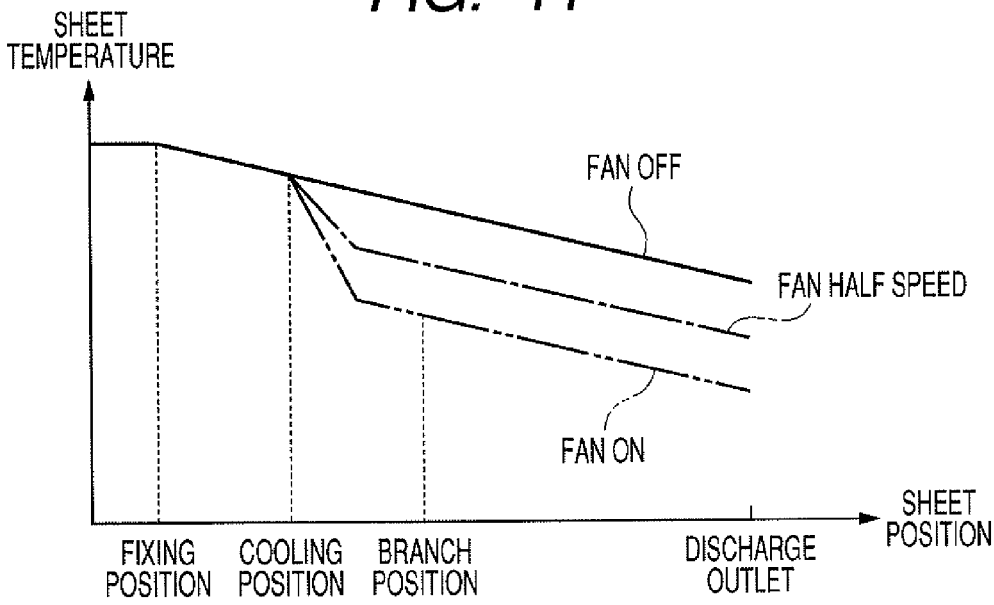
FIG. 11 is a diagram showing the temperature changes of the first type of recording sheet in the case of driving the cooling fan 43 at three kinds of fan rotational speeds in the first fixing mode.
Figure 12:
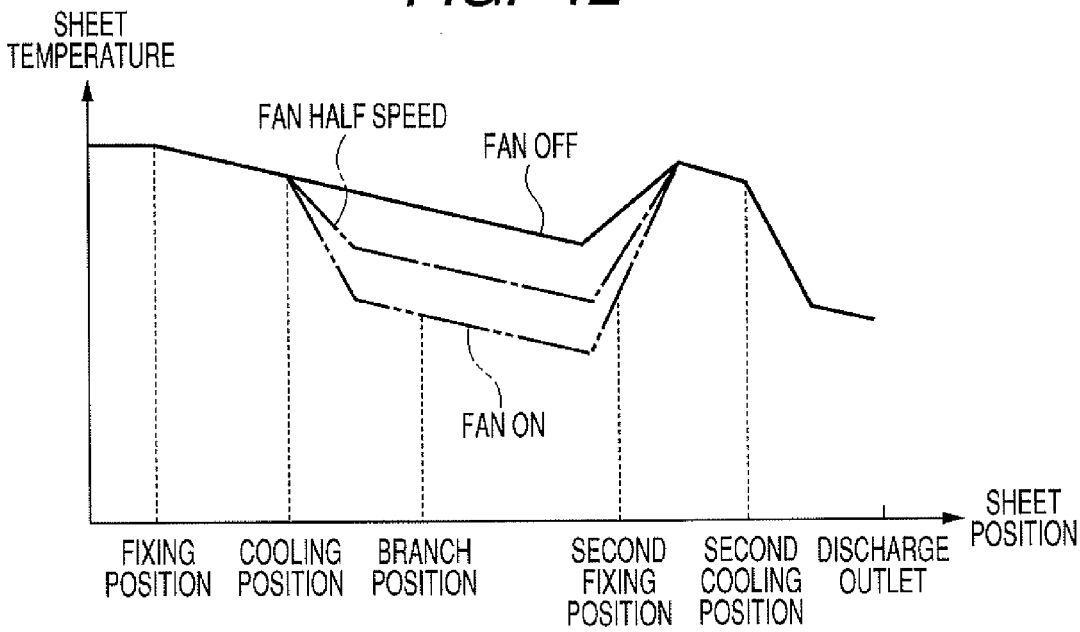
FIG. 12 is a diagram showing the temperature changes of the second type of recording sheet in the case of driving the cooling fan 43 at the three kinds of fan rotational speeds in the second fixing mode.

Temperature changes of the recording sheet in the first and second fixing modes will now be described with reference to FIGS. 9 to 12. FIG. 9 is a diagram showing the temperature change of the first type of recording sheet when the cooling fan 43 is driven at a full rotational speed in the first fixing mode. FIG. 10 is a diagram showing the temperature change of the second type of recording sheet when the cooling fan 43 is driven at the full rotational speed in the second fixing mode. FIG. 11 is a diagram showing the temperature changes of the first type of recording sheet when the cooling fan 43 is driven at three kinds of fan rotational speeds in the first fixing mode. FIG. 12 is a diagram showing the temperature changes of the second type of recording sheet when the cooling fan is driven 43 at the three kinds of fan rotational speeds in the second fixing mode.

When the cooling fan 43 is driven at the full rotational speed in the first fixing mode, as shown in FIG. 9, the first type of recording sheet which has passed through the first fixing unit 40 and has been heated is rapidly cooled at the position of the cooling fan 43 and a temperature (sheet temperature) of the first type of recording sheet drops suddenly. After that, when the first type of recording sheet is conveyed to a position where a cooling effect by the airflow of the cooling fan 43 does not act, the temperature of the first type of recording sheet drops gradually due to a temperature difference between such a temperature and an ambient temperature. At a discharge outlet position (position of the discharge roller 74), when the temperature of the first type of recording sheet decreases to a predetermined temperature or less, a growth of the curl of the first type of recording sheet can be minimized.

When the cooling fan 43 is driven at the full rotational speed in the second fixing mode, as shown in FIG. 10, the second type of recording sheet which has passed through the first fixing unit 40 and has been heated is rapidly cooled at the position of the cooling fan 43 and a temperature (sheet temperature) of the second type of recording sheet drops suddenly. After that, when the second type of recording sheet is conveyed to the position where the cooling effect by the airflow of the cooling fan 43 does not act, the temperature of the second type of recording sheet drops gradually due to the temperature difference between such a temperature and the ambient temperature. The second type of recording sheet is conveyed toward the belt fixing unit 50A by the flapper 107. When the second type of recording sheet passes through the nip portion between the fixing belt 56 of the belt fixing unit 50A and the pressing roller 52, the temperature of the second type of recording sheet rises suddenly. At this time, the belt fixing unit 50A (halogen lamps 59 and 58 of the fixing roller 51 and the pressing roller 52) consumes an electric power corresponding to the amount of the increased temperature, so that the surface temperatures of the fixing roller 51 and the pressing roller 52 decrease.

Subsequently, when the second type of recording sheet enters the cooling area where it is cooled by the cooling fan 55, the temperature of the second type of recording sheet drops suddenly. After that, when the second type of recording sheet is conveyed to a position where a cooling effect by the cooling fan 55 does not act, the temperature of the second type of recording sheet drops gradually due to the temperature difference between such a temperature and the ambient temperature. By decreasing the temperature of the second type of recording sheet, the gloss variation of the image on the second type of recording sheet due to the rub on the conveying rollers and the guide ribs arranged on the downstream of the cooling fan 55 is eliminated. If the temperature of the second type of recording sheet drops to a predetermined temperature or lower at the position of the discharge outlet, the growth of the curl of the second type of recording sheet can be minimized.

The temperature changes of the first type of recording sheet when the cooling fan 43 is driven at three kinds of fan rotational speeds in the first fixing mode will now be described.

First, when the cooling fan 43 is stopped (fan off), as shown in FIG. 11, the temperature (sheet temperature) of the first type of recording sheet does not drop suddenly but decreases gradually until the sheet is conveyed to the position of the discharge outlet. In this case, the first type of recording sheet is curled and stacking performance to the discharge tray 131*a* deteriorates. Since the toner image after the fixing is rubbed by the conveying rollers, guide ribs, and the like in the non-dried state, the gloss variation occurs in the image on the first type of recording sheet.

When the cooling fan 43 is driven at the half rotational speed (fan half), the curl, gloss variation, or the like occurs in the first type of recording sheet although its degree is smaller than that in the case where the cooling fan 43 is stopped. Therefore, to eliminate the occurrence of the gloss variation and the curl, the control is made to drive the cooling fan 43 at the full rotational speed (fan on) in the first fixing mode.

The temperature changes of the second type of recording sheet when the cooling fan 43 is driven at three kinds of fan rotational speeds in the second fixing mode will now be described.

First, when the cooling fan 43 is driven at the full rotational speed (fan on), as shown in FIG. 12, the occurrence of the gloss variation that is caused since the second type of recording sheet after the fixing by the first fixing unit 40 rubs on the conveying rollers, guide ribs, and the like can be eliminated. However, the temperature (sheet temperature) of the second type of recording sheet when the sheet reaches the belt fixing unit 50A has dropped to a very low temperature and a heat capacity which is given to the second type of recording sheet by the belt fixing unit 50A increases.

By heating the second type of recording sheet by the belt fixing unit 50A again, the gloss variation caused in the second type of recording sheet after the fixing by the first fixing unit 40 can be eliminated. Therefore, there is no need to dare to rapidly cool the second type of recording sheet after passing through the first fixing unit 40 by the cooling fan 43. Since the second type of recording sheet which passed through the nip portion of the belt fixing unit 50A is cooled by the cooling fan 55, the occurrence of the gloss variation of the image in the second type of recording sheet can be eliminated and the deterioration of the stacking performance due to the curl can be minimized. Therefore, in the second fixing mode, control to stop (fan off) the cooling fan 43 or drive it at the half rotational speed (fan half) is made so that the temperature (sheet temperature) of the second type of recording sheet when the sheet reaches the belt fixing unit 50A is set to a temperature within the predetermined range. Thus, heat capacity consumption (electric power consumption) in the belt fixing unit 50A can be reduced.

As mentioned above, the temperature change state of the recording sheet when the cooling fan 43 is driven at the half rotational speed (fan half) and the temperature change state of the recording sheet when the cooling fan 43 is stopped (fan off) are obtained. Therefore, curves showing the temperature change states of the recording sheet corresponding to the fan half and the fan off are used as temperature drop distribution data to decide the air volume of the cooling fan 43 or reference data to form such data.

In the embodiment, the first fixing mode or the second fixing mode is set in accordance with the image forming mode. In place of it, the first fixing mode or the second fixing mode may be also selected as a fixing mode by the user operation.

If a jam or the like occurred in the second fixing unit 50 in the second fixing mode, it is also possible to control in such a manner that the fixing mode is switched to the first fixing mode and the subsequent second type of recording sheet which passed through the first fixing unit 40 is delivered to the discharge tray 131*a*.

In step S207 in FIG. 8, in consideration of the detection output of the temperature sensor 109 besides the calculated arrival time and the temperature drop distribution data which has previously been held, the air volume (fan rotational speed) of the cooling fan 43 can be also decided on the basis of them. Therefore, it is possible to consider the fact that a decrease degree of the temperature of the second type of recording sheet differs depending on a difference between the temperature of the second type of recording sheet and the ambient temperature. Thus, the air volume (fan rotational speed) of the cooling fan 43 can be decided so that the temperature of the second type of recording sheet at the time when it reaches the belt fixing unit 50A is certainly set to the temperature within the predetermined range.

The air volume of the cooling fan 43 can be also switched to multi-levels of three or more levels. In place of using the method of directly controlling the air volume (fan rotational speed) of the cooling fan 43, it is also possible to use a construction in which the air volume is controlled by providing an air volume adjusting mechanism such as a damper or the like.

It is also possible that a cooling fan other than the cooling fan 43 is provided on the conveying path 104 and an air volume of such a cooling fan is adjusted.

As mentioned above, according to the embodiment, the image of high picture quality without a gloss variation can be outputted without causing an increase in wasteful electric power consumption in the belt fixing unit 50A and an enlargement in size of the driving mechanism.

Second Embodiment

Figure 13:
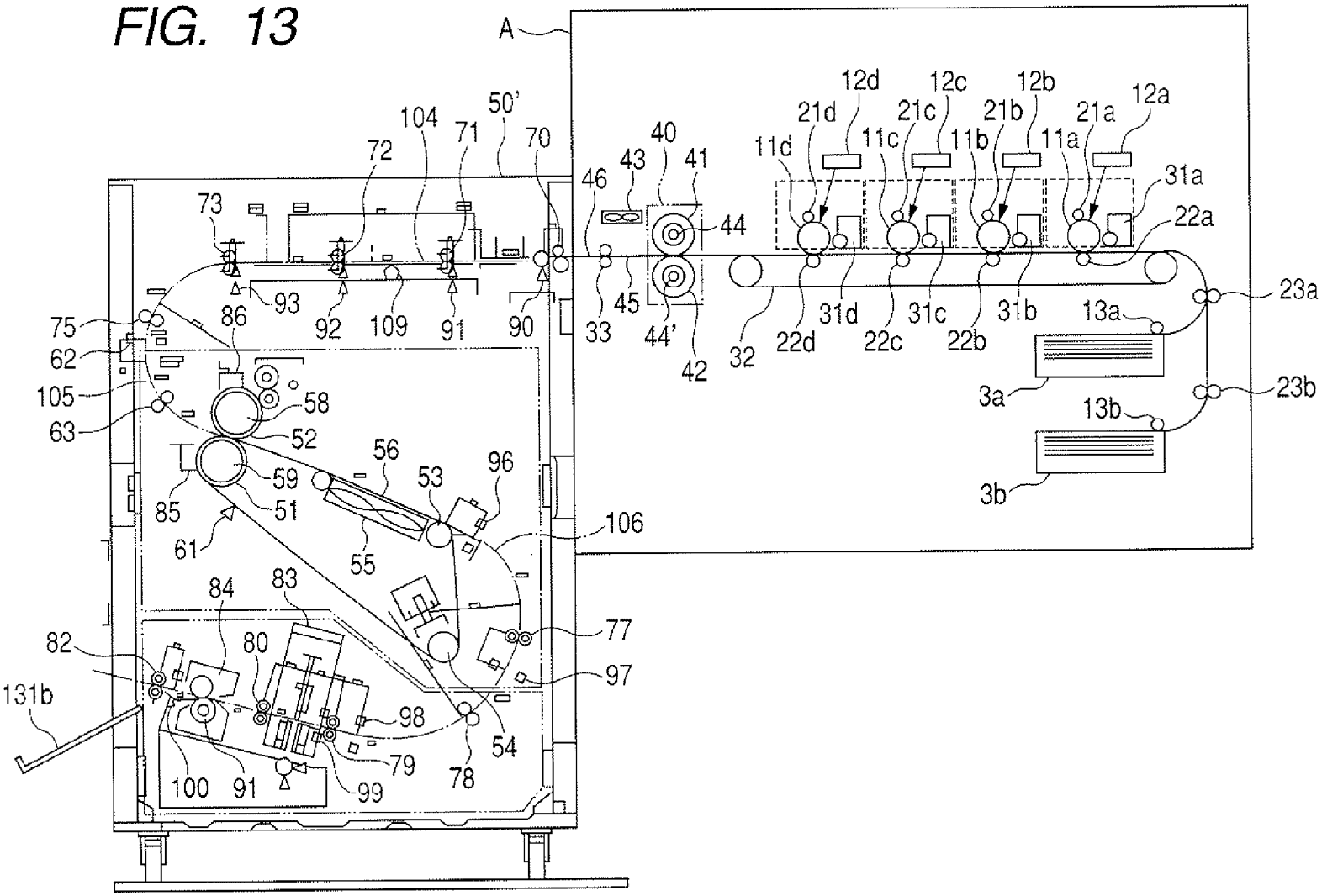
FIG. 13 is a vertical sectional view showing a construction of an image forming apparatus according to the second embodiment of the invention.
Figure 14:
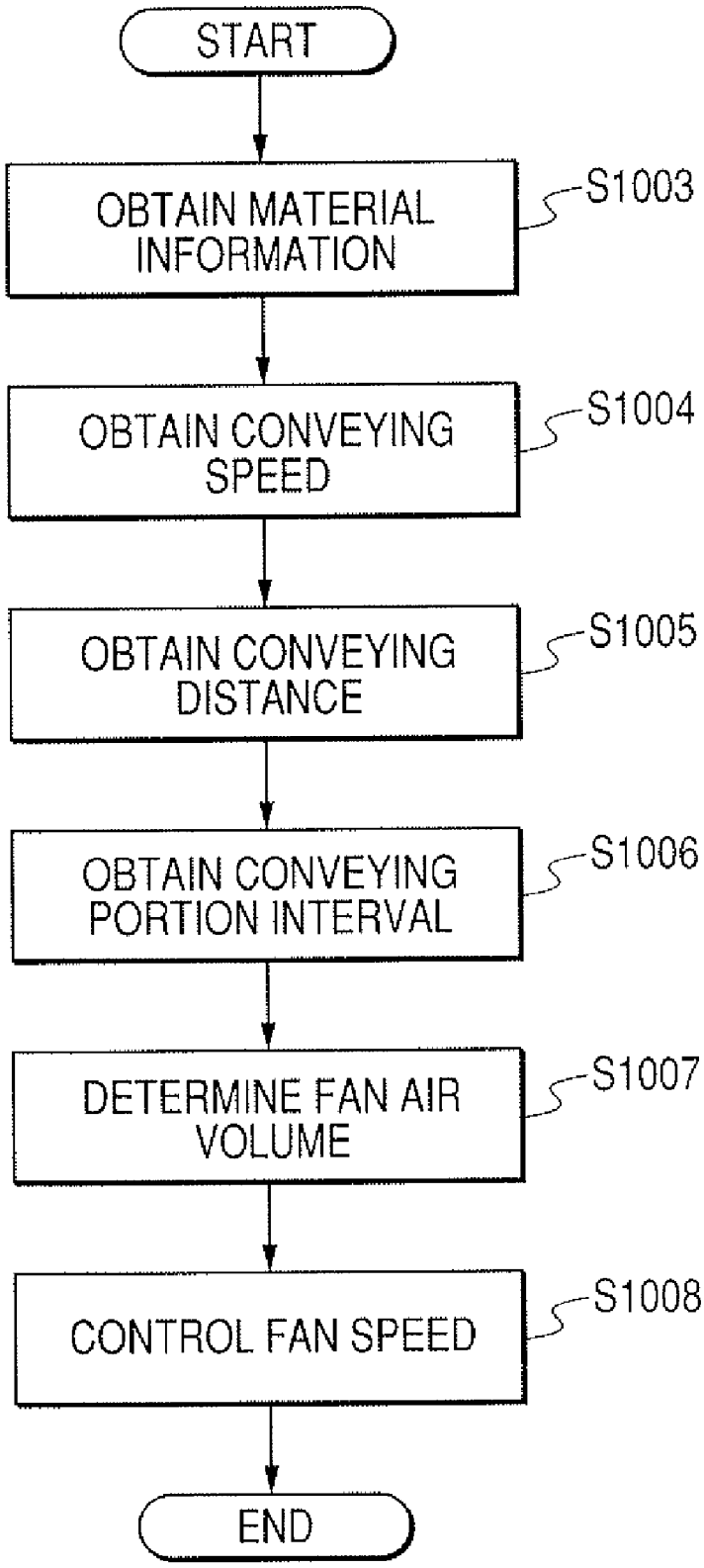
FIG. 14 is a flowchart showing a procedure for the drive control of the cooling fan 43.

The second embodiment of the invention will now be described with reference to FIGS. 13 and 14. FIG. 13 is a vertical sectional view showing a construction of an image forming apparatus according to the second embodiment of the invention. FIG. 14 is a flowchart showing a procedure for the drive control of the cooling fan 43. The procedure shown in the flowchart of FIG. 14 is executed by the controller 400 of the image forming apparatus A.

The image forming apparatus of the second embodiment is constructed as a dedicated apparatus for performing image creation by using only the second type of recording sheet. That is, the second embodiment differs from the foregoing first embodiment with respect to a point that only the second fixing mode can be executed.

Specifically speaking, as shown in FIG. 13, the apparatus A is constructed in such a manner that a second fixing unit 50' connected to the image forming apparatus A guides all of the sheets of recording sheet (second type of recording sheet) delivered from the image forming apparatus A to the belt fixing unit 50A. That is, in the second fixing unit 50', the discharge tray 131*a* and the flapper 107 are not provided for the second fixing unit 50 in the foregoing first embodiment. Other constructions are substantially the same as those of the second fixing unit 50. The image forming apparatus A is substantially the same as that in the first embodiment. Therefore, the same or similar component elements or blocks as those in the first embodiment are designated by the same reference numerals and will be explained by using the same reference numerals.

The drive control of the cooling fan 43 will now be described with reference to FIG. 14. FIG. 14 is the flowchart showing the procedure for the drive control of the cooling fan 43. The procedure shown in the flowchart of FIG. 14 is executed by the controller 400 of the image forming apparatus A.

The drive control of the cooling fan 43 is made by the controller 400 of the image forming apparatus A. This control is started in response to the start of the job. As shown in FIG. 14, first, the controller 400 obtains material information (information regarding the sheet size, material, and the like) of the second type of recording sheet which is fed (step S1003). Subsequently, the controller 400 obtains the conveying speed information of the second type of recording sheet corresponding to the material information obtained in step S1003 from the controller 500 of the second fixing unit 50' (step S1004).

Subsequently, the controller 400 obtains the information indicative of the conveying distance from the first fixing unit 40 to the belt fixing unit 50A in the second fixing unit 50' (step S1005). Subsequently, the controller 400 obtains the conveying portion interval information (step S1006). The controller 400 calculates the arrival time until the second type of recording sheet reaches the belt fixing unit 50A in the second fixing unit 50' from the first fixing unit 40. The controller 400 decides the air volume (fan rotational speed) of the cooling fan 43 to either the first air volume or the second air volume on the basis of the calculated arrival time and the temperature drop distribution data which has previously been held (step S1007).

Subsequently, the controller 400 controls so as to drive the cooling fan 43 at the fan rotational speed according to the air volume of the cooling fan 43 decided in step S1007 (step S1008). For example, when the decided air volume of the cooling fan 43 is the first air volume, the cooling fan 43 is stopped. On the other hand, when the decided air volume of the cooling fan 43 is the second air volume, the cooling fan 43 is driven at the half rotational speed (fan half). The controller 400 finishes the present processing routine.

After that, when the job is finished, the controller 400 stops the driving of the cooling fan 43.

The object of the invention is also accomplished by a method whereby a storing medium in which program codes of software to realize the functions of the embodiments have been recorded is supplied to a system or an apparatus and a computer (or a CPU, an MPU, or the like) of the system or apparatus reads out and executes the program codes stored in the storing medium.

In such a case, the program codes themselves read out of the storing medium realize the functions of the embodiments and the storing medium in which the program codes have been stored constructs the invention.

As a storing medium for supplying the program codes, for example, a floppy (registered trademark) disk, a hard disk, a magnetooptic disk, a CD-ROM, a CD-R, a CD-RW, a DVD-ROM, a DVD-RAM, a DVD-RW, a DVD+RW, a magnetic tape, a non-volatile memory card, a ROM, or the like can be used. The program codes may be downloaded through a network.

The invention incorporates not only the case where the computer executes the read-out program codes, so that the functions of the embodiments are realized but also the case where an OS (Operating System) or the like which is operating in the computer executes a part or all of actual processes on the basis of instructions of the program codes and the functions of the embodiments are realized by those processes.

Further, the invention incorporates the case where the program codes read out of the storing medium are written into a memory provided for a function expanding board inserted in the computer or a function expanding unit connected to the computer, thereafter, a CPU or the like provided for the function expanding board or the function expanding unit executes a part or all of the actual processes on the basis of the instructions of the program codes and the functions of the embodiments are realized by those processes.

Naturally, the invention incorporates not only the case where the computer executes the read-out program codes, so that the functions of the embodiments are realized but also the case where the OS or the like which is operating in the computer executes a part or all of the actual processes on the basis of the instructions of the program codes and the functions of the embodiments are realized by those processes.

In this case, the program is supplied directly from the storing medium in which the program has been stored or supplied by being downloaded from another computer, database, or the like (not shown) connected to the Internet, a commercial network, a local area network, or the like.

The form of the program may be a form of object codes, program codes which are executed by an interpreter, script data which is supplied to the OS (Operating System), or the like.

While the present invention has been described with reference to exemplary embodiments, it is to be understood that the invention is not limited to the disclosed exemplary embodiments. The scope of the following claims is to be accorded the broadcast interpretation so as to encompass all such modifications and equivalent structures and functions.

This application claims priority from Japanese Patent Application No. 2005-257065 filed Sep. 5, 2005, which is hereby incorporated by reference herein.

What is claimed is:

1. An image forming apparatus comprising:

a first heating device which heats a recording sheet on which a developer image has been formed;

a cooling device, which is disposed downstream from the first heating device in a conveying direction of the recording sheet, and which cools the recording sheet which has passed through said first heating device;

a second heating device, which is disposed downstream from the cooling device in the conveying direction of the recording sheet, and which heats the recording sheet cooled by said cooling device and gives a gloss to the image on said recording sheet;

a conveying device which conveys the recording sheet which has passed through said first heating device to said second heating device through said cooling device; and a controller which controls a cooling ability of said cooling device in accordance with a conveying time that is required until the recording sheet is conveyed from said first heating device to said second heating device;

wherein said controller makes the cooling ability of said cooling device lower as said conveying time is longer.

2. An apparatus according to claim 1, wherein said controller predicts said conveying time and controls the cooling ability of said cooling device on the basis of the predicted conveying time.

3. An apparatus according to claim 2, wherein said controller further controls the cooling ability of said cooling device on the basis of data indicative of temperature change characteristics of the recording sheet in such a manner that a temperature of the recording sheet when it has reached said second heating device lies within a predetermined temperature range.

4. An apparatus according to claim 1, wherein said cooling device has a cooling fan and said controller controls an amount of current which is supplied to said cooling fan based on the conveying time.

5. An apparatus according to claim 1, wherein said conveying device has a function for temporarily stopping the recording sheet which is conveyed and conveying it again, and said conveying time includes a time period in which the recording sheet is temporarily stopped.

6. An apparatus according to claim 3, wherein said predetermined temperature range is set in accordance with information of at least a size, a material, and a thickness of said recording sheet.

7. An apparatus according to claim 1, wherein said recording sheet is recording sheet on which a resin layer has been formed.

8. A control method for an image forming apparatus having a first heating device which heats a recording sheet on which a developer image has been formed, a cooling device, which is disposed downstream from the first heating device in a conveying direction of the recording sheet, and which cools the recording sheet which has passed through said first heating device, a second heating device, which is disposed downstream from the cooling device in the conveying direction of the recording sheet, and which heats the recording sheet cooled by said cooling device and gives a gloss to the image on said recording sheet, and a conveying device which conveys the recording sheet which has passed through said first heating device to said second heating device through said cooling device, wherein said control method comprises:

a predicting step of predicting a conveying time that is required until the recording sheet is conveyed from said first heating device to said second heating device; and a control step of controlling a cooling ability of said cooling device lower as the predicted conveying time is longer.

* * * * *